US011389863B2

(12) United States Patent
Lee et al.

(10) Patent No.: US 11,389,863 B2
(45) Date of Patent: Jul. 19, 2022

(54) COLLECTOR NOZZLE FOR CONTINUOUS CASTING

(71) Applicant: Hyundai Steel Company, Incheon (KR)

(72) Inventors: Jung Min Lee, Chungcheongnam-do (KR); Woong Gan Ki, Chungcheongnam-do (KR); Young Min Park, Incheon (KR); Hyeok Jang, Chungcheongnam-do (KR)

(73) Assignee: Hyundai Steel Company, Incheon (KR)

( * ) Notice: Subject to any disclaimer, the term of this patent is extended or adjusted under 35 U.S.C. 154(b) by 65 days.

(21) Appl. No.: 16/963,293

(22) PCT Filed: Jul. 31, 2018

(86) PCT No.: PCT/KR2018/008727
§ 371 (c)(1),
(2) Date: Jul. 20, 2020

(87) PCT Pub. No.: WO2019/164069
PCT Pub. Date: Aug. 29, 2019

(65) Prior Publication Data

US 2021/0362219 A1 Nov. 25, 2021

(30) Foreign Application Priority Data

Feb. 22, 2018 (KR) ..... 10-2018-0021137

(51) Int. Cl.
*B22D 41/50* (2006.01)
*B22D 41/54* (2006.01)
*B22D 11/103* (2006.01)

(52) U.S. Cl.
CPC ..... *B22D 11/103* (2013.01); *B22D 41/502* (2013.01); *B22D 41/505* (2013.01); *B22D 41/54* (2013.01)

(58) Field of Classification Search
CPC .. B22D 11/103; B22D 41/502; B22D 41/505; B22D 41/54; B22D 41/56
See application file for complete search history.

(56) References Cited

U.S. PATENT DOCUMENTS 5,725,925 A * 3/1998 Ichikawa ..... B22D 41/502 266/905
2006/0118268 A1 6/2006 Collura et al.

FOREIGN PATENT DOCUMENTS

EP 2878861 A1 * 6/2015 ..... B22D 41/502
JP S50-060311 U 6/1975
JP S58-134245 U 9/1983
JP H01-133654 A 5/1989
JP H03-221248 A 9/1991
(Continued)

*Primary Examiner* — Kevin E Yoon
(74) *Attorney, Agent, or Firm* — Fox Rothschild LLP

(57) ABSTRACT

A collector nozzle for continuous casting may include: a nozzle body extended toward a shroud nozzle, and having an internal movement path through which molten steel is moved; a first case covering a side surface of the nozzle body; and a second case including a second metal component, connected to the first case, and covering an exit surface of the nozzle body facing the shroud nozzle. The first case can include a first metal component, and the first and second cases may be connected through welding or formed as one body.

7 Claims, 11 Drawing Sheets

(56) References Cited

FOREIGN PATENT DOCUMENTS

| | | | |
|---|---|---|---|
| JP | H7-9555 | U | 2/1995 |
| JP | H07-033453 | U | 6/1995 |
| JP | 11-090592 | | 4/1999 |
| JP | H11-179533 | A | 7/1999 |
| JP | 2006-508804 | A | 3/2006 |
| JP | 2009-241121 | A | 10/2009 |
| JP | 2010-207894 | A | 9/2010 |
| JP | 2017-514692 | A | 6/2017 |
| KR | 10-2002-0097329 | A | 12/2002 |
| KR | 20-2010-0003387 | U | 3/2010 |
| KR | 10-2013-0099331 | A | 9/2013 |
| KR | 10-1790002 | B1 | 10/2017 |
| KR | 10-2017-0130810 | A | 11/2017 |
| WO | 2015078617 | A1 | 6/2015 |
| WO | 2015171114 | A1 | 11/2015 |

* cited by examiner

COLLECTOR NOZZLE FOR CONTINUOUS CASTING

CROSS-REFERENCE TO RELATED APPLICATION(S)

This application is a National Phase of PCT International Application No. PCT/KR2018/008727 with an International Filing Date of Jul. 31, 2018, which claims under 35 U.S.C. § 119(a) the benefit of Korean Application No. 10-2018-0021137, filed on Feb. 22, 2018, the entire contents of which are incorporated by reference herein.

BACKGROUND

(a) Technical Field

The present disclosure relates to a collector nozzle for continuous casting, more particularly, to the collector nozzle which can prevent base metal from adhering to a shroud facing the collector nozzle.

(b) Description of the Related Art

In general, a continuous caster refers to equipment which receives molten steel, which is made in a steel making furnace and transferred to a ladle, in a tundish and supplies the molten steel to a mold for the continuous caster to manufacture a casting. In order to transfer the molten steel from the ladle to the tundish, a collector nozzle coupled to the ladle and a shroud nozzle installed at the top of the tundish are used.

One example of related art to the present disclosure is disclosed in Korean Patent No. 10-1790002 registered on Oct. 19, 2017 and entitled "Nozzle, Apparatus of Continuous Casting and Method thereof".

SUMMARY

Embodiments of the present disclosure are directed to a collector nozzle for continuous casting, which can prevent base metal from adhering to a shroud facing the collector nozzle.

In an embodiment, a collector nozzle for continuous casting may include: a nozzle body extended toward a shroud nozzle, and having an internal movement path through which molten steel is moved; a first case covering a side surface of the nozzle body; and a second case including a second metal component, connected to the first case, and covering an exit surface of the nozzle body facing the shroud nozzle.

The first case may include a first metal component, and the first and second cases are connected through welding or formed as one body.

The second case may cover the entire exit surface.

The second case may cover an edge of the exit surface.

The collector nozzle may further include a protrusion part having a plurality of protrusion members extended downward from the second case.

The protrusion members of the protrusion part may be arranged in a zigzag shape in a circumferential direction of the second case.

The protrusion part may be obliquely installed in a diagonal direction.

The protrusion part may include a third metal component.

In the collector nozzle for continuous casting in accordance with the embodiment of the present disclosure, the second case including a second metal component is installed at the bottom of the nozzle body, and base metal formed between the nozzle body and the shroud nozzle adheres to the second case and is automatically removed, which makes it possible to reduce a maintenance cost.

DETAILED DESCRIPTION

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof. Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereafter, a collector nozzle for continuous casting in accordance with an embodiment of the present disclosure will be described in detail with reference to the accompanying drawings. It should be noted that the drawings are not to precise scale and may be exaggerated in thickness of lines or sizes of components for descriptive convenience and clarity only.

Furthermore, the terms as used herein are defined by taking functions of the present disclosure into account and can be changed according to the custom or intention of users or operators. Therefore, definition of the terms should be made according to the overall disclosures set forth herein.

Figure 1:
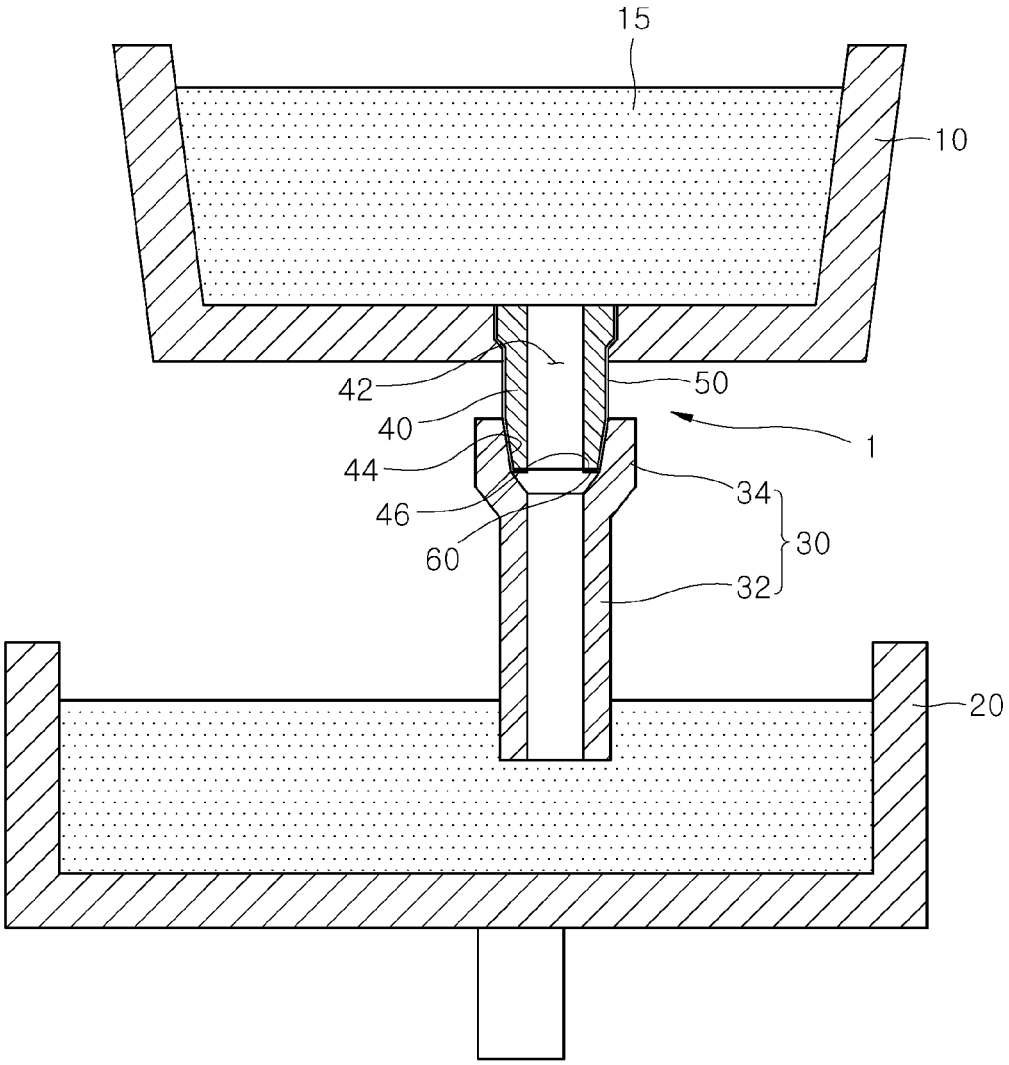
FIG. 1 is a diagram schematically illustrating that a collector nozzle for continuous casting in accordance with an embodiment of the present disclosure is installed.
Figure 2:
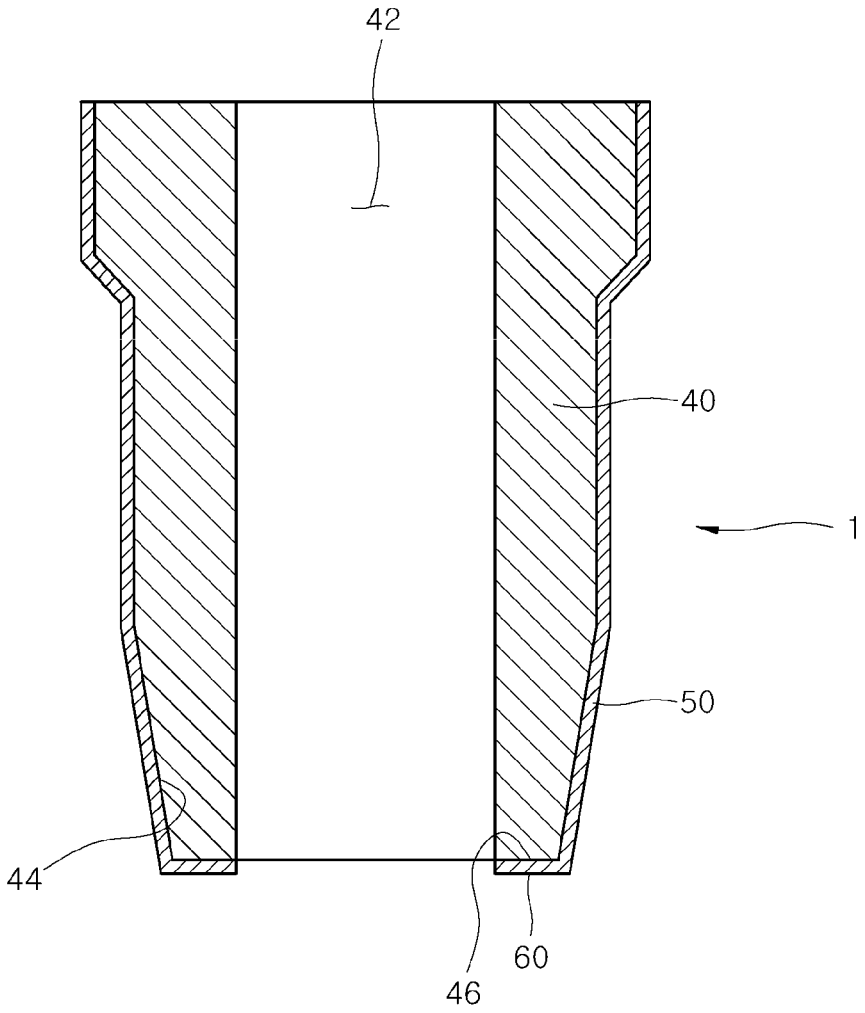
FIG. 2 is a cross-sectional view of the collector nozzle for continuous casting in accordance with the embodiment of the present disclosure.
Figure 3:
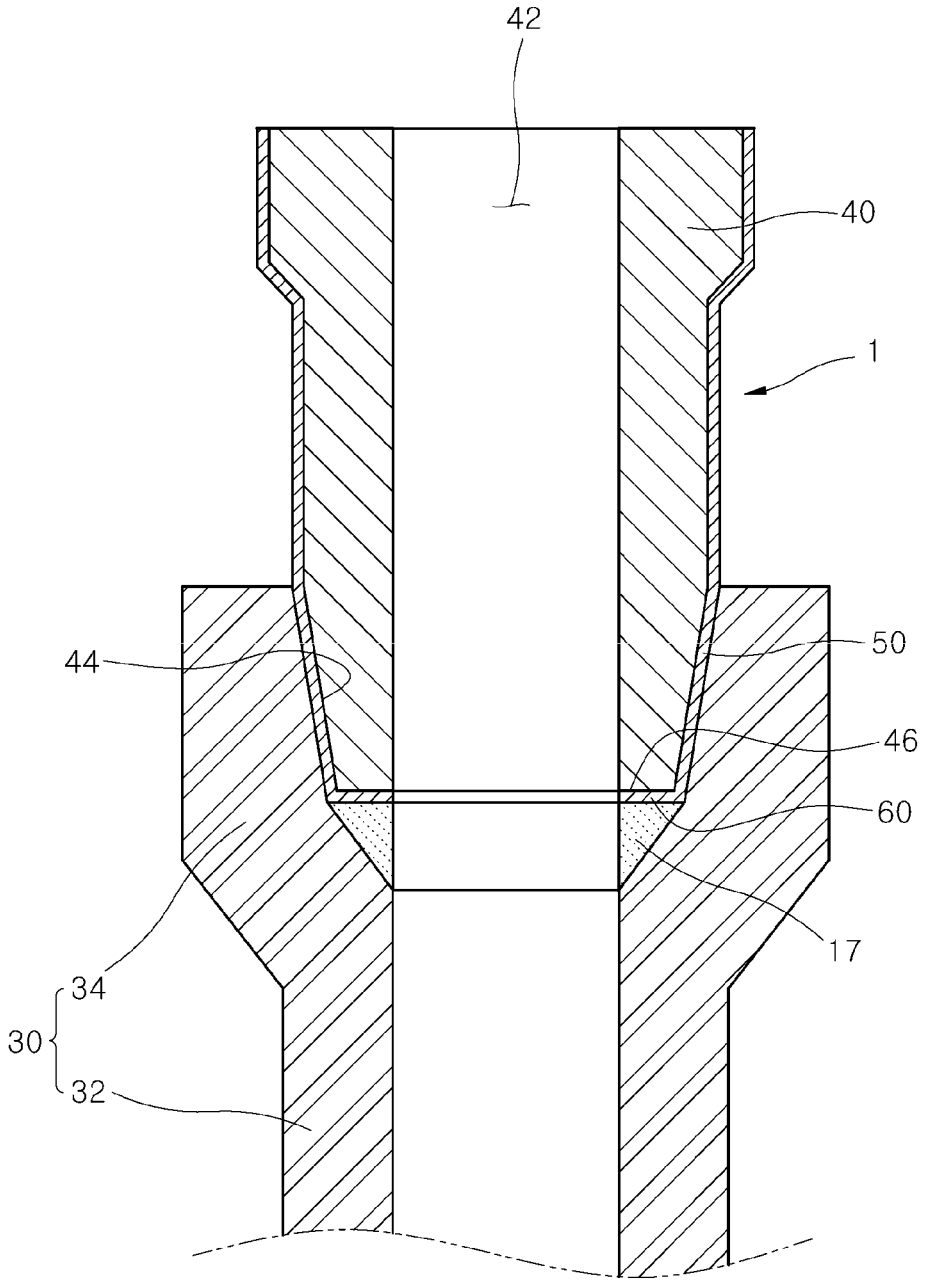
FIG. 3 is a cross-sectional view illustrating that base metal is formed between a shroud nozzle and the collector nozzle for continuous casting in accordance with the embodiment of the present disclosure.
Figure 4:
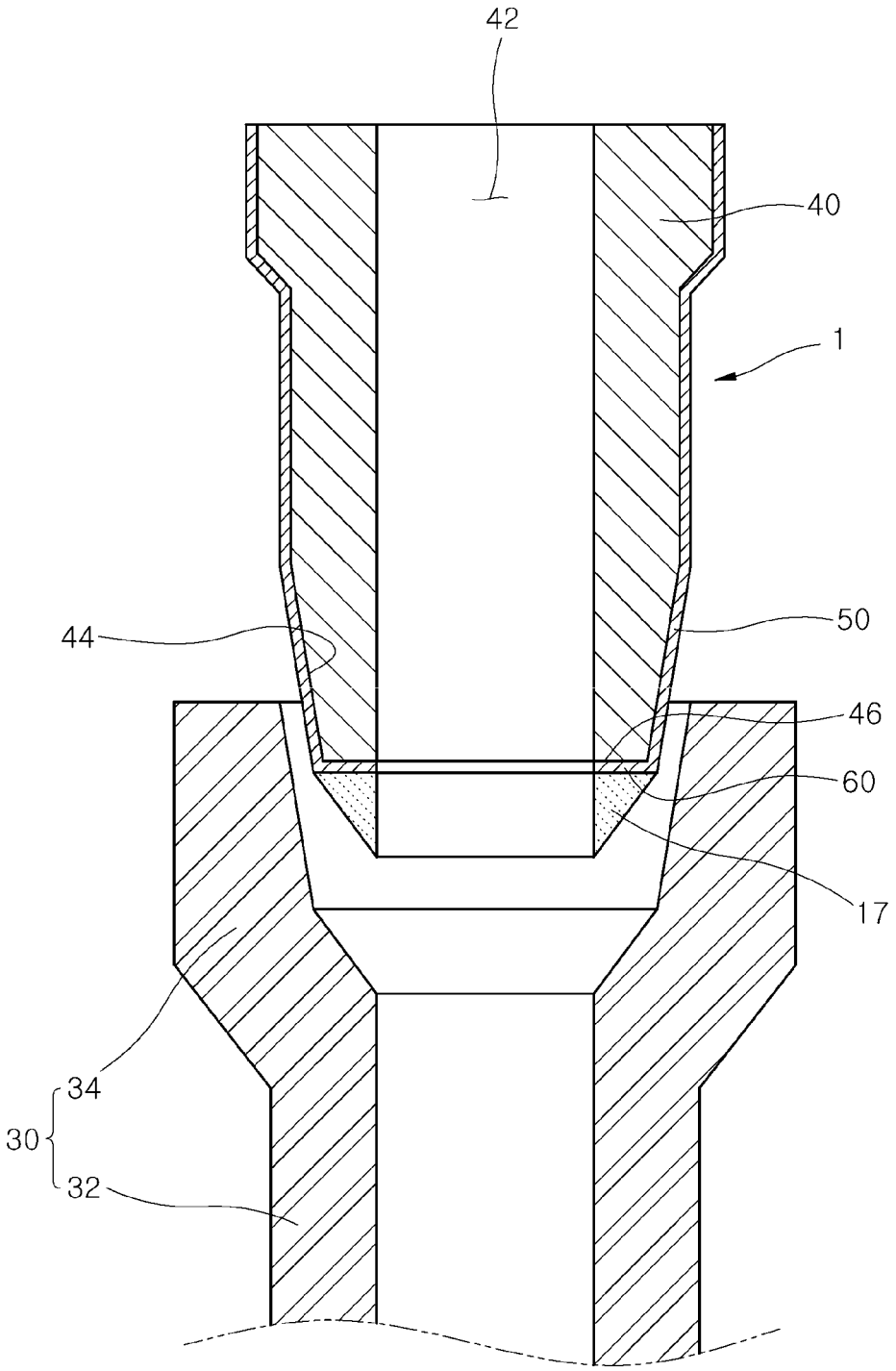
FIG. 4 is a cross-sectional view illustrating that base metal adheres to a second case in accordance with the embodiment of the present disclosure.
Figure 5:
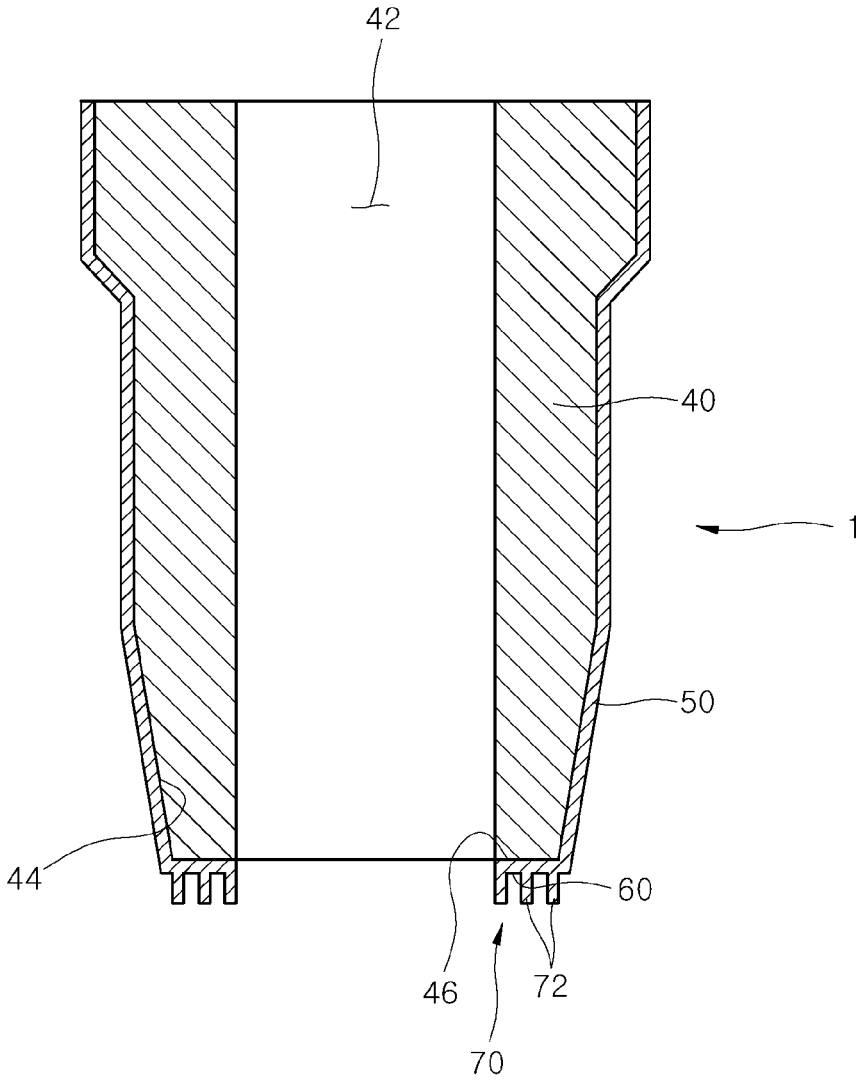
FIG. 5 is a cross-sectional view illustrating that a protrusion part is additionally installed on the second case in accordance with the embodiment of the present disclosure.
Figure 6:
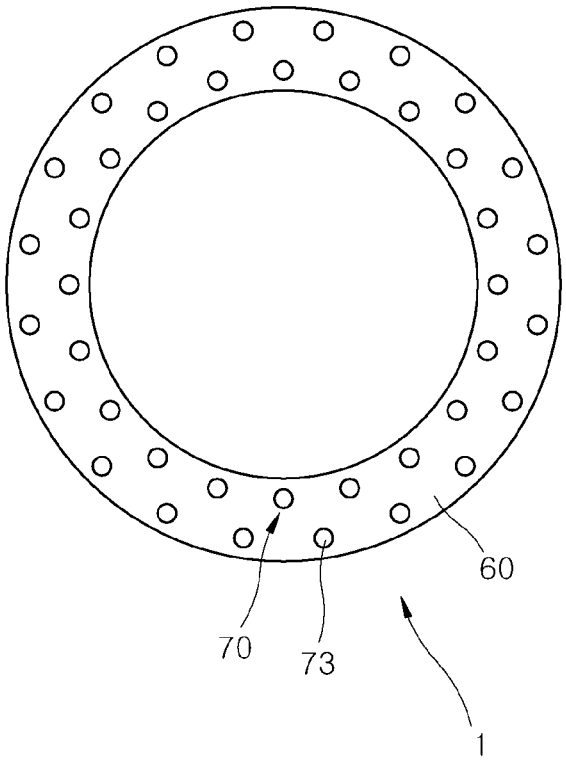
FIG. 6 is a bottom view illustrating that the protrusion part in accordance with the embodiment of the present disclosure is installed in a zigzag shape along the second case.
Figure 7:
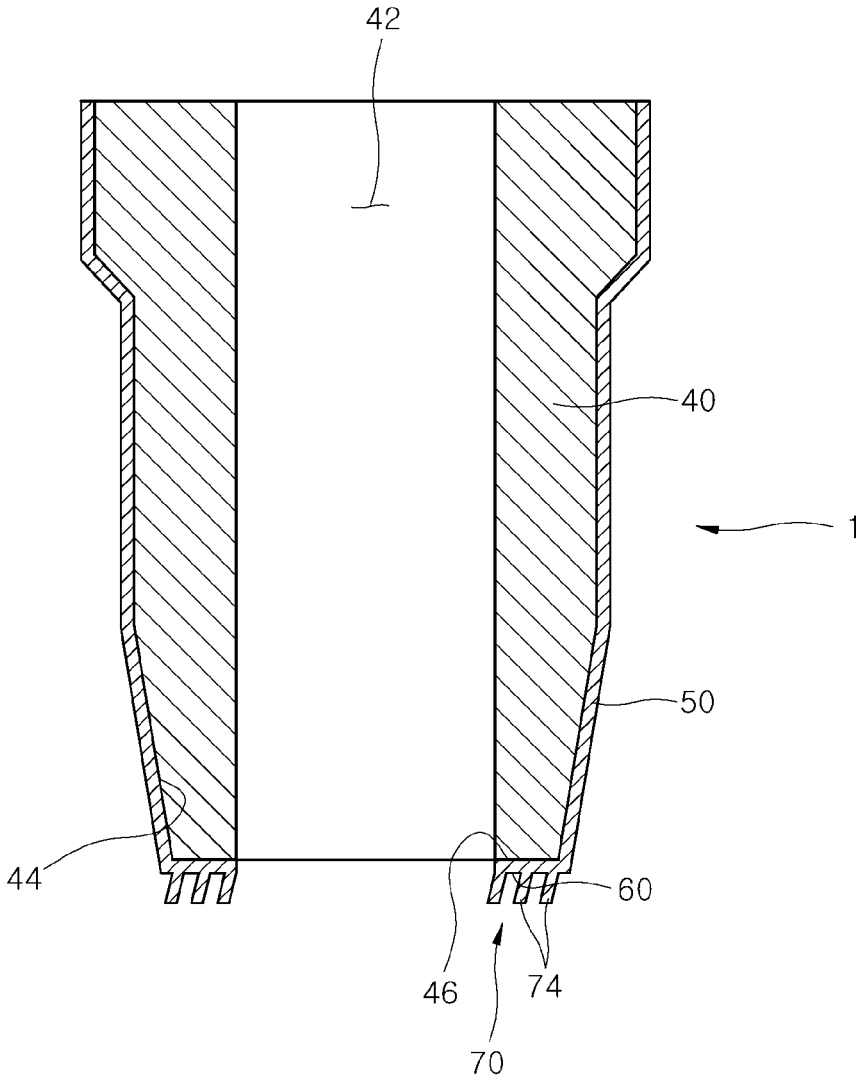
FIG. 7 is a cross-sectional view illustrating that the protrusion part in accordance with the embodiment of the present disclosure is obliquely installed.

FIG. 1 is a diagram schematically illustrating that a collector nozzle for continuous casting in accordance with an embodiment of the present disclosure is installed, FIG. 2 is a cross-sectional view of the collector nozzle for continuous casting in accordance with the embodiment of the present disclosure, FIG. 3 is a cross-sectional view illustrating that base metal is formed between a shroud nozzle and the collector nozzle for continuous casting in accordance with the embodiment of the present disclosure, FIG. 4 is a cross-sectional view illustrating that base metal adheres to a second case in accordance with the embodiment of the present disclosure, FIG. 5 is a cross-sectional view illustrating that a protrusion part is additionally installed on the second case in accordance with the embodiment of the present disclosure, FIG. 6 is a bottom view illustrating that the protrusion part in accordance with the embodiment of the present disclosure is installed in a zigzag shape along the second case, and FIG. 7 is a cross-sectional view illustrating that the protrusion part in accordance with the embodiment of the present disclosure is obliquely installed.

As illustrated in FIGS. 1 to 4, the collector nozzle 1 for continuous casting in accordance with the embodiment of the present disclosure includes a nozzle body 40, a first case 50 and a second case 60. The nozzle body 40 is extended toward a shroud nozzle 30 and has an internal movement path 42 for molten steel 15. The first case 50 covers a side surface of the nozzle body 40. The second case 60 includes a second metal component, is connected to the first case 50, and covers an exit surface 46 of the nozzle body 40 facing the shroud nozzle 30.

Continuous casting refers to a casting method for continuously casting slabs or steel ingots while molten metal is solidified in a mold with no bottom. The continuous casting is used to manufacture an elongated product having a simple cross-section such as a square, rectangle or circle and a slab, bloom or billet which is mainly used as a material for rolling. The continuous casting is performed through a ladle 10 and a tundish 20.

The ladle 10 has an internal space for containing the molten steel 15 which has steel component content formed through a refining process. The tundish 20 receives the molten metal from the ladle 10 and supplies the molten metal to the mold. The ladle 10 is provided as a pair of ladles which alternately receive the molten steel 15 and supply the molten steel 15 to the tundish 20.

In order to guide the molten steel 15 from the ladle 10 to the tundish 20, the shroud nozzle 30 and the collector nozzle 1 for continuous casting are used. The collector nozzle 1 for continuous casting is connected to the ladle 10, and the shroud nozzle 30 is installed at the bottom of the collector nozzle 1 for continuous casting.

Since the structure for moving the molten steel 15 in the ladle 10 to the tundish 20 through the collector nozzle 1 for continuous casting and the shroud nozzle 30 is publicly known, the detailed descriptions thereof will be omitted herein. Furthermore, since the structure in which the shroud nozzle 30 is erected at the top of the tundish 20 is also publicly known, the detailed descriptions thereof will be omitted herein.

The shroud nozzle 30 in accordance with the embodiment includes a shroud body 32 and a guide member 34. The shroud body 32 is extended in the top-to-bottom direction and has an internal path through which the molten steel 15 is moved, and the guide member 34 is spread obliquely toward the outside from the top of the shroud body 32. The shroud nozzle 30 is made of a refractory material, and prevents oxidation when the molten steel 15 is guided.

The nozzle body 40 is extended toward the shroud nozzle 30, and has the internal movement path 42 for the molten steel 15. The upper part of the nozzle body 40 is connected to the ladle 10, and the lower part of the nozzle body 40 is located inside the guide member 34 of the shroud nozzle 30.

The nozzle body 40 is extended in the top-to-bottom direction, and has an outer inclined surface 44 formed at a side surface of the lower part thereof. The nozzle body 40 having the outer inclined surface 44 has an outer diameter that gradually decreases toward the bottom thereof. The outer inclined surface 44 formed at the lower part of the nozzle body 40 has the same or similar angle as or to an inclined surface formed inside the guide member 34 of the shroud nozzle 30. Therefore, since the nozzle body 40 is guided downward along the guide member 34, the nozzle body 40 and the shroud nozzle 30 may be rapidly and easily connected to each other.

The nozzle body 40 has the ring-shaped exit surface 46 formed at the bottom thereof in a horizontal direction, and the second case 60 may be deformed in various manners to cover the entire exit surface 46 or only the edge 48 of the exit surface 46.

The first case 50 is installed in a shape to cover the side surface of the nozzle body 40. The second case 60 includes a second metal component, is connected to the first case 50, and covers the entire exit surface 46 of the nozzle body 40 facing the shroud nozzle 30.

The first case 50 is installed in a shape to cover the lateral outer surface of the nozzle body 40, and the second case 60 is installed in a shape to cover the exit surface 46 formed at the bottom of the nozzle body 40. The first case 50 and the second case 60 are connected through welding or formed as one body.

The nozzle body 40 is made of a refractory material such as ceramic, and the first and second cases 50 and 60 preferably each include a metal component (e.g., first and second metal components, respectively). Therefore, base metal 17 formed between the collector nozzle 1 for continuous casting and the shroud nozzle 30 adheres to the second case 60 including the second metal component.

Since the second case 60 covers the entire exit surface 46, the base metal 17 formed between the collector nozzle 1 for continuous casting and the shroud nozzle 30 adheres to the second case 60. The temperature of the molten steel moved downward through the movement path 42 of the nozzle body 40 is about 1,550° C., and the second case 60 is heated at a temperature of 1,000° C. to 1,400° C. with the collector nozzle 1 lowered to face the shroud nozzle 30. Therefore, the base metal 17 adheres to the second case 60 while the second case 60 including steel is partially molten.

Since the first case 50 is installed in such a manner that the outside of the first case 50 abuts on the inner surface of the guide member 34, fluid including gas is blocked from moving between the guide member 34 and the first case 50. Therefore, since a separate sealing member for blocking fluid from moving between the guide member 34 and the first case 50 is omitted, an installation cost and maintenance cost can be reduced.

In order to improve the sealing performance between the first case 50 and the guide member 34, the inclination angles of the outer surface of the first case 50 and the inner surface of the guide member 34 are equal or similar to each other within an error range. Thus, the surface contact between the first case 50 and the guide member 34 may be induced to improve the sealing performance.

The first and second cases 50 and 60 may be made of a material each including a metal component (e.g., the first and second metal components, respectively). Alternatively, only the second case 60 may be made of a material including the second metal component, and the first case 50 may be made of a material which includes a smaller amount of the first metal component than the second case 60 or no first metal component.

When the second case 60, which is installed in the horizontal direction while covering the lower end of the nozzle body 40, is located inside the shroud nozzle 30, a space in which the base metal 17 is to be formed is provided between the second case 60 and the guide member 34. Therefore, the base metal 17 formed between the second case 60 and the guide member 34 of the shroud nozzle 30 may easily adhere to the second case 60 located on the top side. The second case 60 in accordance with the embodiment is used for the adherence of the base metal 17, and may be deformed in various shapes and made of various materials, as long as the base metal 17 formed between the shroud nozzle 30 and the second case 60 can easily adhere.

When the base metal 17 adheres to the shroud nozzle 30, the shroud nozzle 30 needs to be lifted from the molten steel 15 and subjected to oxygen cleaning, in order to remove the base metal 17 on the shroud nozzle 30. Thus, the manufacturing process is stopped, which results in reducing the productivity. Furthermore, the base metal 17 removed from the shroud nozzle 30 falls into the tundish 20 and thus degrades the quality of the molten steel 15. Moreover, since a worker needs to work in a high-temperature environment, the stability of the work may be reduced.

Furthermore, when the shroud nozzle 30, which has been cleaned with oxygen to remove the base metal 17, is installed in the tundish 20 again with slag floating on the surface of the molten steel 15 in the tundish 20, air may be introduced into the molten steel 15, and the slag floating on the molten steel 15 may be mixed with the molten steel 15, thereby degrading the quality of the molten steel 15.

According to the collector nozzle 1 for continuous casting in accordance with the embodiment of the present disclosure, the base metal 17 does not adhere to the shroud nozzle 30, but adheres to the second case 60 of the collector nozzle 1 for continuous casting and moves toward the top of the shroud nozzle 30. Therefore, an oxygen cleaning work for removing the base metal 17 from the shroud nozzle 30 does not need to be performed, and the shroud nozzle 30 may be continuously used while erected at the top of the tundish 20. Therefore, it is possible to prevent the degradation in work stability and the reduction in quality and productivity of the molten steel 15, which may occur when the shroud nozzle 30 is cleaned.

In general, the collector nozzle 1 for continuous casting cannot be reused after one use, and the shroud nozzle 30 can be continuously reused. Therefore, the base metal 17 may be induced to adhere to the second case 60 of the collector nozzle 1 for continuous casting, which is discarded after one use, in order to minimize the base metal 17 adhering to the shroud nozzle 30. Thus, the state in which the shroud nozzle 30 is installed in the tundish 20 can be continuously maintained, and the attachment/detachment period of the shroud nozzle 30 can be increased.

When the collector nozzle 1 for continuous casting is lifted, the second case 60 having the base metal 17 adhering thereto is lifted together. Thus, the operation of removing the base metal 17 from the shroud nozzle 30 can be stably performed.

As illustrated in FIG. 5, the collector nozzle 1 for continuous casting in accordance with the embodiment further includes a protrusion part 70 having a plurality of protrusion members 72 extended downward from the second case 60. The plurality of protrusion members 72 protrude downward from the second case 60. The protrusion members 72 may be formed in various shapes such as a rod shape extended in a vertical or diagonal direction, as long as the protrusion members 72 can protrude downward from the second case 60 and increase a contact area with the base metal 17. Therefore, the base metal 17 may more easily adhere to the second case 60 and the protrusion part 70 having an increased contact area with the base metal 17, and be removed from the shroud nozzle 30. Since the protrusion part includes a third metal component (where the "third" metal component may be the same or different than the first and second metal components of the first and second cases, respectively), the base metal 17 adheres to the second case 60 and the protrusion part, with the protrusion part 70 and the second case 60 partially molten. Therefore, since an area for fixing the base metal 17 moved upward with the collector nozzle 1 for continuous casting is increased, it is possible to significantly reduce the possibility that the base metal 17 will fall down to cause an accident.

The protrusion part 70 in accordance with the embodiment of the present disclosure may be installed in such a shape that a plurality of protrusion members 72 are extended downward from the second case 60. As illustrated in FIG. 6, a plurality of protrusion members 73 of the protrusion part 70 may be arranged in a zigzag shape in the circumferential direction of the second case 60. Since the protrusion members 73 are arranged in a zigzag shape and connected to the second case 60, the distance between the adjacent protrusion members 73 can be easily secured. Therefore, although a smaller number of protrusion members 73 are installed, the base metal 17 may easily adhere and move.

Alternatively, as illustrated in FIG. 7, protrusion members 74 of the protrusion part 70 may be obliquely installed in a diagonal direction. Therefore, it is possible to prevent the base metal 17 from falling down during a work of lifting the base metal 17 adhering to the protrusion members 74 and the second case 60, thereby significantly reducing the possibility that an accident will occur.

Hereafter, the operation state of the collector nozzle 1 for continuous casting in accordance with the embodiment of the present disclosure will be described in detail with reference to the accompanying drawings.

As illustrated in FIG. 1, the collector nozzle 1 for continuous casting is located at the top of the shroud nozzle 30, with the first and second cases 50 and 60 installed outside the nozzle body 40. The molten steel 15 in the ladle 10 is moved to the tundish 20 through the collector nozzle 1 for continuous casting and the shroud nozzle 30.

At this time, as illustrated in FIG. 3, the base metal 17 is formed between the second case 60 and the guide member 34, as the molten steel 15 is solidified. The base metal 17 adheres to the second case 60 whose surface is molten. Therefore, when the collector nozzle 1 for continuous casting and the shroud nozzle 30 are separated after the work for moving the molten steel 15 is completed, the base metal 17 adheres to the second case 60 and is removed from the shroud nozzle 30.

Alternatively, when the protrusion part 70 is additionally installed on the bottom of the second case 60 illustrated in FIGS. 5 to 7, the base metal 17 adhering to both of the protrusion part 70 and the second case 60 may be moved upward with the collector nozzle 1 for continuous casting, which makes it possible to prevent the base metal from adhering to the shroud nozzle 30.

Hereafter, a collector nozzle 1 for continuous casting in accordance with another embodiment of the present disclosure will be described with reference to the drawings.

For convenience of description, components which are configured and operated in the same manner as those of the controller nozzle in accordance with the above embodiment will be represented by like reference numerals, and the detailed descriptions thereof will be omitted.

Figure 8:
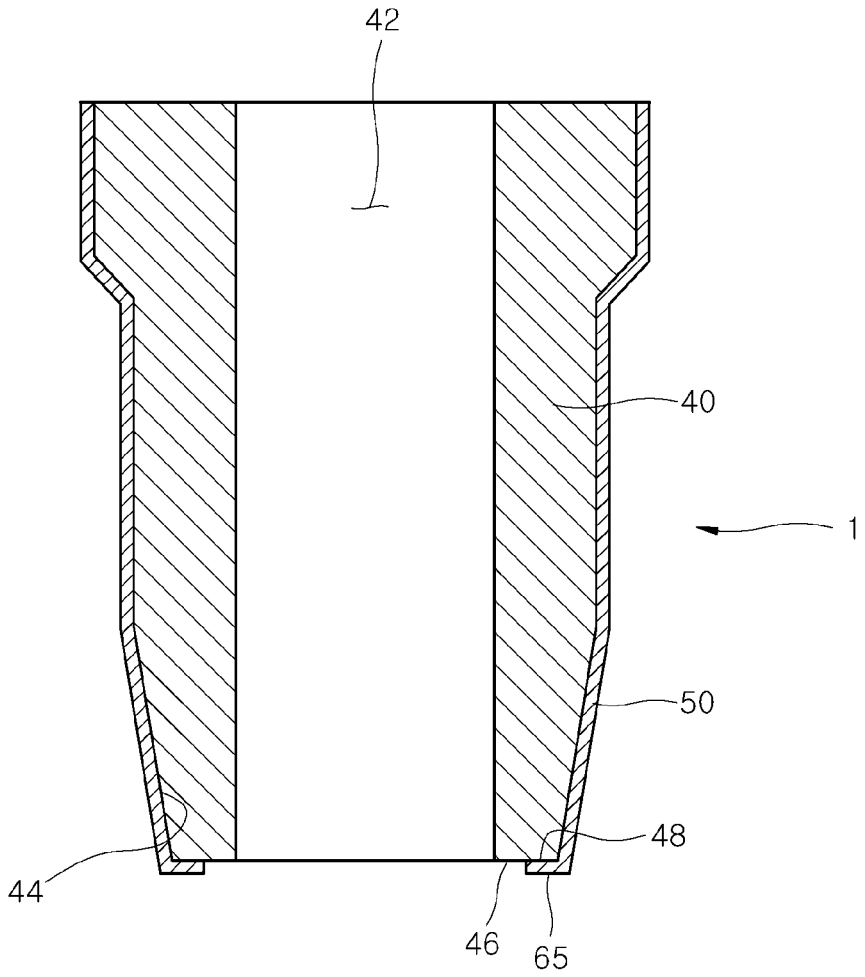
FIG. 8 is a cross-sectional view illustrating that a second case in accordance with another embodiment of the present disclosure is installed.
Figure 9:
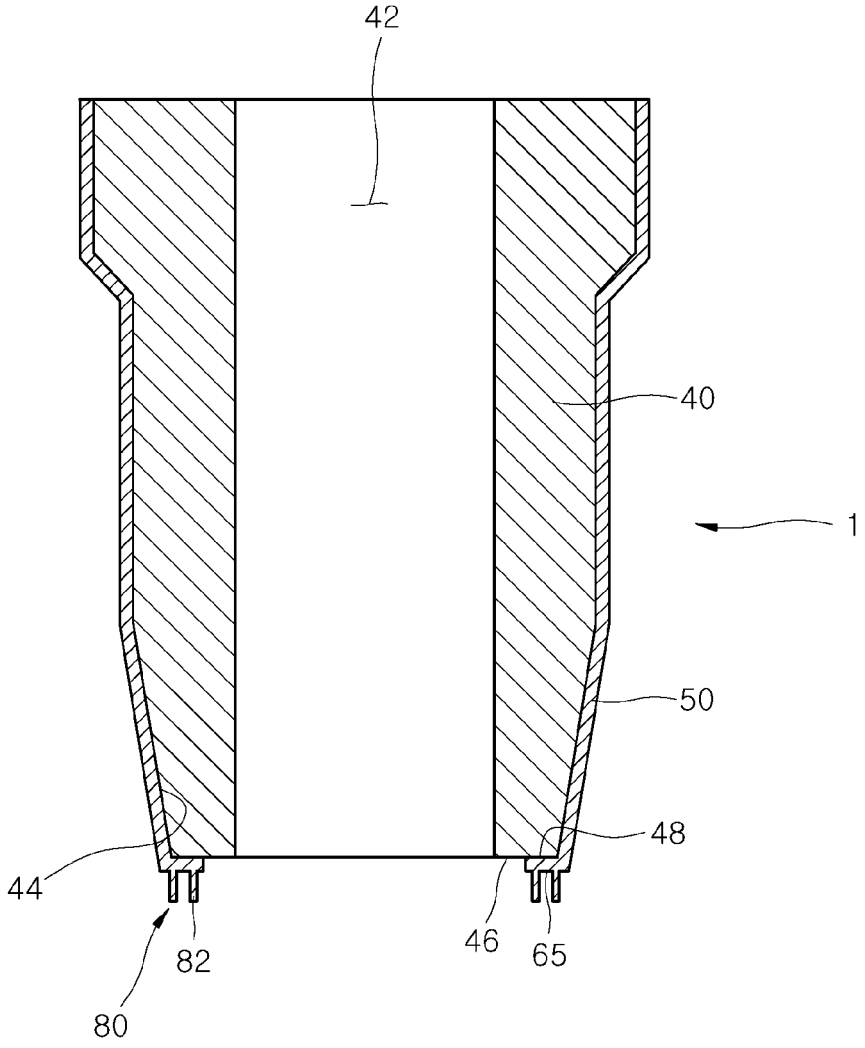
FIG. 9 is a cross-sectional view illustrating that a protrusion part is installed on the second case in accordance with the embodiment of the present disclosure.
Figure 10:
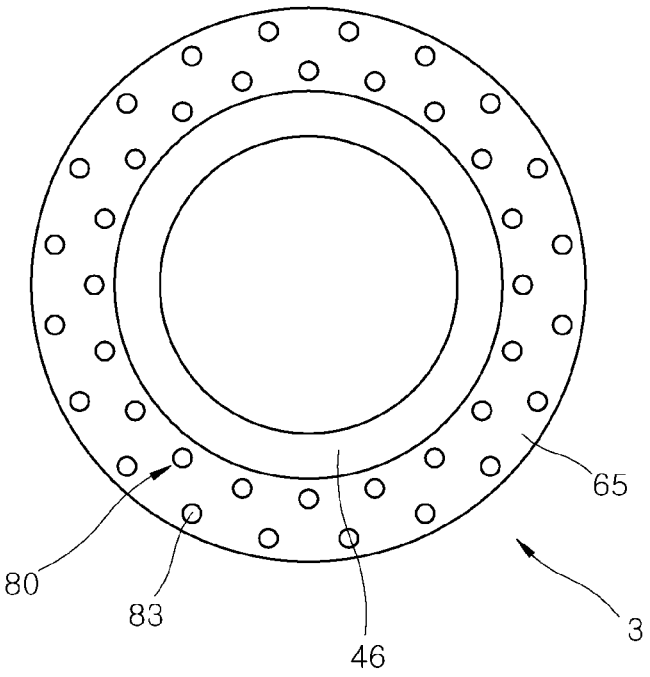
FIG. 10 is a bottom view illustrating that the protrusion part in accordance with the embodiment of the present disclosure is installed in a zigzag shape along the second case.
Figure 11:
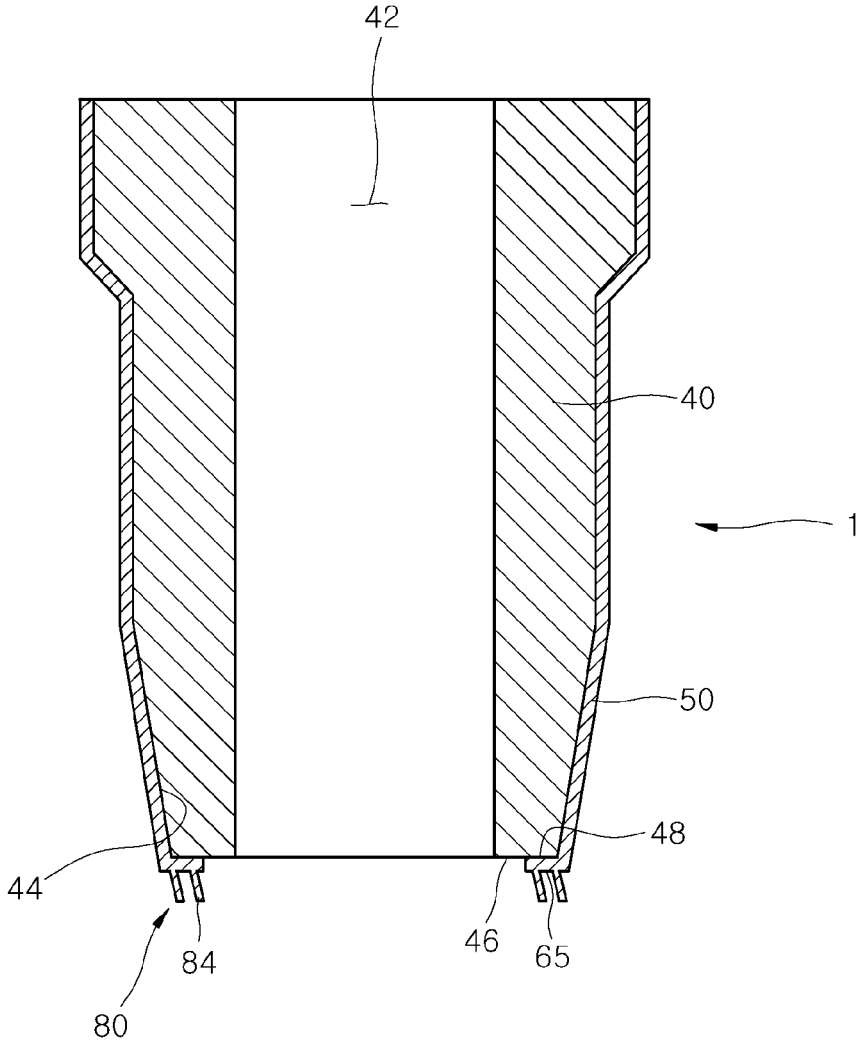
FIG. 11 is a cross-sectional view illustrating that the protrusion part in accordance with the embodiment of the present disclosure is obliquely installed.

FIG. 8 is a cross-sectional view illustrating that a second case in accordance with another embodiment of the present disclosure is installed, FIG. 9 is a cross-sectional view illustrating that a protrusion part is installed on the second case in accordance with the embodiment of the present disclosure, FIG. 10 is a bottom view illustrating that the protrusion part in accordance with the embodiment of the present disclosure is installed in a zigzag shape along the second case, and FIG. 11 is a cross-sectional view illustrating that the protrusion part in accordance with the embodiment of the present disclosure is obliquely installed.

As illustrated in FIG. 8, a second case 65 installed in a collector nozzle 1 for continuous casting in accordance with another embodiment of the present disclosure covers an edge 48 of an exit surface 46. Although the second case 65 does not cover the entire area of the exit surface 46, a part of the second case 65 installed in the horizontal direction abuts on base metal 17 formed between the collector nozzle 1 for continuous casting and the shroud nozzle 30. Thus, the base metal 17 may easily adhere to the second case 65.

As illustrated in FIG. 9, the second case 65 in accordance with the embodiment of the present disclosure may further include a protrusion part 80 having a plurality of protrusion members 82. Even in such a case, the base metal 17 may easily adhere to the collector nozzle 1 for continuous casting.

The protrusion part 80 in accordance with the embodiment of the present disclosure may be installed in such a shape that the plurality of protrusion members 82 are extended downward from the second case 65. As illustrated in FIG. 10, the plurality of protrusion members 83 of the protrusion part 80 may be arranged in a zigzag shape in the circumferential direction of the second case 65. Since the protrusion members 83 are arranged in a zigzag shape and connected to the second case 65, the distance between the adjacent protrusion members 83 can be easily secured. Therefore, although a smaller number of protrusion members 83 are installed, the base metal 17 may easily adhere and move.

Alternatively, as illustrated in FIG. 11, protrusion members 84 of the protrusion part 80 may be obliquely installed in a diagonal direction. Therefore, it is possible to prevent the base metal 17 from falling down during a work of lifting the base metal 17 adhering to the protrusion members 84 and the second case 65, thereby significantly reducing the possibility that an accident will occur.

In accordance with the present disclosure, the second case 60 or 65 including the second metal component is installed at the bottom of the nozzle body 40, and the base metal 17 formed between the nozzle body 40 and the shroud nozzle 30 adheres to the second case 60 or 65 and is automatically removed, which makes it possible to reduce a maintenance cost. Furthermore, since the protrusion part 70 or 80 is additionally installed on the second case 60 or 65 to induce the adherence of the base metal 17, it is possible to prevent the base metal 17 from falling down during a work of removing the base metal 17 from the shroud nozzle 30, thereby significantly reducing the possibility that an accident will occur.

Although some embodiments have been provided to illustrate the present disclosure in conjunction with the drawings, it will be apparent to those skilled in the art that the embodiments are given by way of illustration only, and that various modifications and equivalent embodiments can be made without departing from the spirit and scope of the present disclosure. The scope of the present disclosure should be limited only by the accompanying claims.

The invention claimed is:

1. A collector nozzle for continuous casting, comprising:

a nozzle body extended toward a shroud nozzle, and having an internal movement path through which molten steel is moved;

a first case covering a side surface of the nozzle body;

a second case including a second metal component, connected to the first case, and covering an exit surface of the nozzle body facing the shroud nozzle; and a protrusion part having a plurality of protrusion members extended downward from the second case, wherein the protrusion members of the protrusion part are arranged in a zigzag shape in a circumferential direction of the second case.

2. The collector nozzle of claim 1, wherein the first case includes a first metal component, and the first and second cases are connected through welding or formed as one body.

3. The collector nozzle of claim 1, wherein the second case entirely covers the exit surface of the nozzle body.

4. The collector nozzle of claim 1, wherein the second case covers an edge of the exit surface.

5. The collector nozzle of claim 1, wherein the protrusion part includes a third metal component.

6. A collector nozzle for continuous casting, comprising:

a nozzle body extended toward a shroud nozzle, and having an internal movement path through which molten steel is moved;

a first case covering a side surface of the nozzle body;

a second case including a second metal component, connected to the first case, and covering an exit surface of the nozzle body facing the shroud nozzle; and a protrusion part having a plurality of protrusion members extended downward from the second case, wherein the protrusion part is obliquely installed in a diagonal direction.

7. The collector nozzle of claim 6, wherein the protrusion part includes a third metal component.

* * * * *